US007419352B2

(12) United States Patent
Guentert et al.

(10) Patent No.: US 7,419,352 B2
(45) Date of Patent: Sep. 2, 2008

(54) METHODS AND APPARATUS FOR ASSEMBLING TURBINE ENGINES

(75) Inventors: Joseph M. Guentert, Cincinnati, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/538,273

(22) Filed: Oct. 3, 2006

(65) Prior Publication Data

US 2008/0080968 A1 Apr. 3, 2008

(51) Int. Cl.
*F01D 9/04* (2006.01)

(52) U.S. Cl. ..... 415/189; 415/209.3

(58) Field of Classification Search ..... 415/189, 415/190, 209.2, 209.3, 209.4, 210.1; 60/796, 60/798, 800

See application file for complete search history.

(56) References Cited

U.S. PATENT DOCUMENTS 4,687,413 A 8/1987 Prario
4,793,770 A 12/1988 Schonewald et al.
4,989,406 A 2/1991 Vdoviak et al.
5,118,120 A * 6/1992 Drerup et al. ..... 277/628
5,232,340 A 8/1993 Morgan
6,418,727 B1 * 7/2002 Rice et al. ..... 60/799
6,637,753 B2 * 10/2003 Mohammed-Fakir et al. .... 277/416
6,893,217 B2 5/2005 Brainch et al.
6,921,246 B2 7/2005 Brainch et al.
6,983,608 B2 1/2006 Allen, Jr. et al.
2004/0239050 A1 * 12/2004 Antunes et al. ..... 277/630
2005/0132715 A1 6/2005 Allen, Jr. et al.
2006/0133922 A1 6/2006 Heyward et al.

* cited by examiner

*Primary Examiner*—Edward Look
*Assistant Examiner*—Nathaniel Wiehe
(74) *Attorney, Agent, or Firm*—William Scott Andes, Esq.; Armstrong Teasdale LLP

(57) ABSTRACT

A method for assembling a gas turbine engine is provided. The method includes providing a turbine nozzle including an outer band and an inner band, wherein each band includes a leading edge, a trailing edge, and a body extending therebetween. At least one of the outer band and the inner band has at least one radial tab extending outward therefrom. The method also includes coupling at least one seal between at least one of the radial tabs extending from the outer band and the inner band and a respective leading edge of the outer and inner band. The method also includes positioning at least one non-planar seal support against at least one portion of the seal.

20 Claims, 5 Drawing Sheets

METHODS AND APPARATUS FOR ASSEMBLING TURBINE ENGINES

BACKGROUND OF THE INVENTION

This invention relates generally to turbine engines and more particularly, to methods and apparatus for assembling gas turbine engines.

At least some known gas turbine engines include combustors which ignite fuel-air mixtures which are then channeled through a turbine nozzle assembly towards a turbine. Some known turbine nozzle assemblies include a plurality of arcuate nozzle segments arranged circumferentially. At least some known turbine nozzles include a plurality of circumferentially-spaced hollow airfoil vanes coupled by integrally-formed inner and outer band platforms. More specifically, the inner band forms a portion of the radially inner flowpath boundary and the outer band forms a portion of the radially outer flowpath boundary.

To facilitate improving engine efficiency, at least some known engine assemblies include a seal, commonly known as a leaf seal, coupled between the turbine nozzle outer band and an aft end of the combustor. Known leaf seals are retained in position via a plurality of coil springs coupled to a plurality of fasteners that extend through radial tabs extending from the outer band. The coil springs enable the leaf springs to shift during engine operations. Because of the orientation of known turbine nozzle radial tabs, one end of known leaf springs is unsupported. In such engine assemblies, when combustion gases discharged from the combustor approach the nozzle vane leading edge, a pressure or bow wave may be formed from the vane leading edge stagnation and propagate a distance upstream from the nozzle assembly. Such bow waves may induce circumferential pressure variations across the leaf seal. Over time, exposing the leaf seal to such pressure variations may cause cracks to develop along the seal. Specifically, the unsupported free end of the leaf seal may break thus decreasing engine efficiency and/or, depending on the extent of the damage, may render the engine inoperable.

FIG. 1 is a side view of an exemplary known turbine nozzle 50 that may be used with a gas turbine engine. FIG. 2 is a perspective view of turbine nozzle 50. In the exemplary embodiment, nozzle 50 is one segment of a plurality of segments that are positioned circumferentially to form a nozzle assembly (not shown) within the gas turbine engine. Nozzle 50 includes at least one airfoil vane 52 that extends between an arcuate radially outer band or platform 54, and an arcuate radially inner band or platform 56. More specifically, in the exemplary embodiment, outer band 54 and the inner band 56 are each integrally-formed with airfoil vane 52.

Vane 52 includes a pressure-side sidewall 60 and a suction-side sidewall 62 that are connected at a leading edge 64 and at a chordwise-spaced trailing edge 66 such that a cooling cavity 68 is defined between sidewalls 60 and 62. Vane sidewalls 60 and 62 each extend radially between bands 54 and 56 and in the exemplary embodiment, sidewall 60 is generally concave, and sidewall 62 is generally convex.

Outer and inner bands 54 and 56 each include a leading edge 70 and 72, respectively, a trailing edge 74 and 76, respectively, and a platform body 78 and 80, respectively, extending therebetween. In the exemplary embodiment, airfoil vane(s) 52 are oriented such that outer and inner band leading edges 70 and 72, respectively, are each a distance d upstream from airfoil vane leading edge 64. Distance d is variably selected to ensure that leading edges 70 and 72 are upstream from vane leading edge 64, and to facilitate preventing hot gas injections along vane leading edge 64, as described in more detail below.

In the exemplary embodiment, inner band 56 includes an aft flange 90 that extends radially inwardly therefrom. More specifically, flange 90 extends radially inwardly from band 56 with respect to a radially inner surface 92 of band 56. Inner band 56 also includes a forward flange 94 that extends radially inward therefrom. Forward flange 94 is positioned between inner band leading edge 72 and aft flange 90, and extends radially inwardly from band 56. In the exemplary embodiment, an upstream side 100 of forward flange 94 is substantially planar between a radially outermost surface 102 of flange 94 and radially inner surface 92. Moreover, in the exemplary embodiment, a downstream side 106 of flange 94 is substantially planar from flange surface 102 to radially inner surface 92.

Inner band 56 also includes a plurality of circumferentially-spaced radial tabs 110 that extend radially inwardly therefrom. More specifically, in the exemplary embodiment, the number of radial tabs 110 extending from inner band 56 is the same as the number of vanes 52. In the exemplary embodiment, each tab 110 includes substantially parallel upstream and downstream surfaces 120 and 122, respectively. Radial tabs 110 are spaced a distance $d_2$ downstream from forward flange 94 such that a retention channel 130 is defined between each radial tab 110 and forward flange 94.

In the exemplary embodiment, outer band 54 includes an aft flange 140 that extends generally radially outwardly therefrom. More specifically, flange 140 extends radially outwardly from band 54 with respect to a radially outer surface 142 of band 54. Outer band 54 also includes a forward flange 144 that extends radially outward therefrom. Forward flange 144 is positioned between outer band leading edge 70 and aft flange 140, and extends radially outward from band 54. In the exemplary embodiment, an upstream side 146 of forward flange 144 is substantially planar between a radially outermost surface 147 of flange 144 and band radially outer surface 142. Moreover, in the exemplary embodiment, a downstream side 148 of flange 144 is substantially planar from flange surface 147 to radially outer surface 142.

Outer band 54 also includes a plurality of circumferentially-spaced radial tabs 160 that extend radially outwardly therefrom. More specifically, in the exemplary embodiment, the number of radial tabs 160 is the same as the number of vanes 52. In the exemplary embodiment, each tab 160 includes substantially parallel upstream and downstream surfaces 162 and 164, respectively. Radial tabs 160 are spaced a distance $d_3$ downstream from forward flange 144 such that a retention channel 166 is defined between each radial tab 160 and forward flange 144.

In the exemplary embodiment, channels 166 are approximately the same size as channels 130.

In the exemplary embodiment, inner band 56 includes a circumferentially-adjacent leaf seal assembly 168 including a seal 170 that is positioned between forward flange 94 and radial tab 110. Moreover, in the exemplary embodiment, each nozzle assembly 50 includes one seal 170. In an alternative embodiment, each nozzle assembly 50 includes more than one seal 170. In another alternative embodiment, one seal 170 extends across two or more circumferentially-adjacent nozzle assemblies 50. Seal 170 is positioned adjacent forward flange 94 and is coupled to radial tab 110 via a fastener 172, such as a coil spring, as illustrated in the exemplary embodiment, that extends through an aperture 174 defined in radial tab 110. As will be appreciated by one skilled in the art, seal 170 may be coupled to radial tab 110 with any suitable coupling mechanism that functions as described herein. In the exemplary embodiment, a spring 176 circumscribes fastener 172 and is positioned between forward flange 94 and radial tab 110.

In the exemplary embodiment, outer band 54 includes a circumferentially-adjacent leaf seal assembly 178 including a seal 180 that is positioned between forward flange 144 and radial tab 160. More specifically, in the exemplary embodiment, each nozzle assembly 50 includes one seal 180. In an alternative embodiment, each nozzle assembly 50 includes more than one of seal 180. In another alternative embodiment, one seal 180 extends across two or more circumferentially-adjacent nozzle assemblies 50. Seal 180 is positioned adjacent forward flange 144 and is coupled to radial tab 160 via a fastener 182, such as a coil spring, as illustrated in the exemplary embodiment, that extends through an aperture 184 defined in radial tab 160. As will be appreciated by one skilled in the art, seal 180 may be coupled to radial tab 160 with any suitable coupling mechanism that functions as described herein. In the exemplary embodiment, a spring 186 circumscribes fastener 182 and is positioned between forward flange 144 and radial tab 160.

BRIEF SUMMARY OF THE INVENTION

In one aspect, a method for assembling a gas turbine engine is provided. The method includes providing a turbine nozzle including an outer band and an inner band, wherein each band includes a leading edge, a trailing edge, and a body extending therebetween. At least one of the outer band and the inner band has at least one radial tab extending outward therefrom. The method also includes coupling at least one seal between at least one of the radial tabs extending from the outer band and the inner band and a respective leading edge of the outer and inner band. The method also includes positioning at least one non-planar seal support against at least one portion of the seal.

In another aspect, a turbine engine nozzle assembly is provided. The assembly includes an outer band comprising a leading edge, a trailing edge, and a body extending therebetween, and an inner band comprising a leading edge, a trailing edge, and a body extending therebetween. At least one of the inner band and the outer band includes at least one radial tab extending outward therefrom. The assembly also includes at least one vane extending between the outer and inner bands. The assembly also includes at least one seal coupled between at least one radial tab and one of the band leading edges, and at least one non-planar seal support positioned against at least one portion of the seal.

In a further aspect, a turbine engine is provided. The turbine engine includes a plurality of adjacent nozzle assemblies. Each nozzle assembly includes an outer band comprising a leading edge, a trailing edge, and a body extending therebetween, and an inner band comprising a leading edge, a trailing edge, and a body extending therebetween. At least one of the inner band and the outer band includes at least one radial tab extending outward therefrom. Each assembly also includes at least one vane extending between the outer and inner bands. Each assembly also includes at least one seal coupled between at least one radial tab and one of the band leading edges, and at least one non-planar seal support positioned against at least one portion of the seal to facilitate preventing breakage of the seal due to vibration.

DETAILED DESCRIPTION OF THE INVENTION

Figure 3:
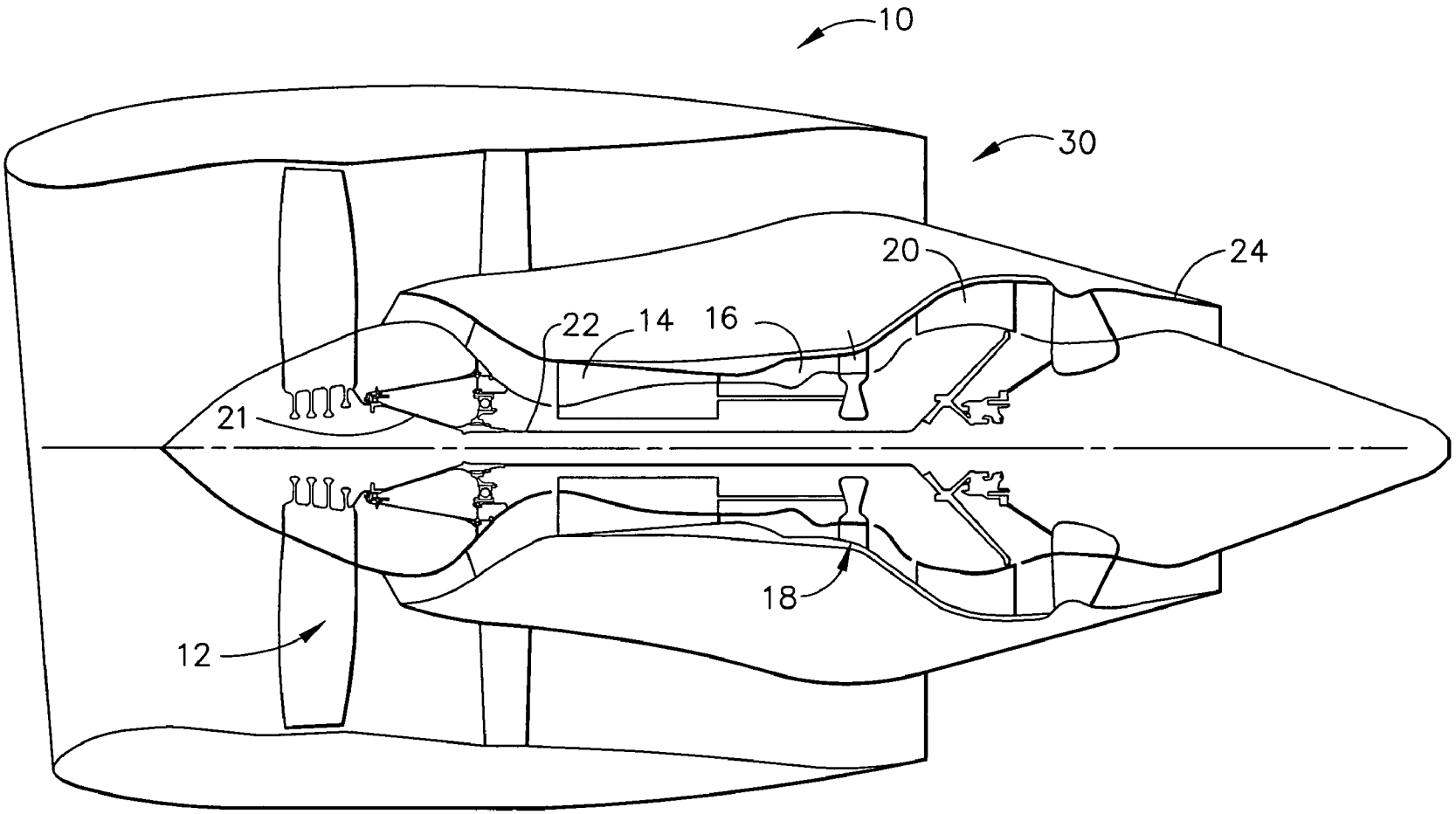
FIG. 3 is a schematic illustration of an exemplary gas turbine engine.

FIG. 3 is a schematic illustration of an exemplary gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 21, and compressor 14 and turbine 18 are coupled by a second shaft 22. In one embodiment, gas turbine engine 10 is an LM2500 engine commercially available from General Electric Aircraft Engines, Cincinnati, Ohio. In another embodiment, gas turbine engine 10 is a CFM engine commercially available from General Electric Company, Cincinnati, Ohio.

Figure 1:
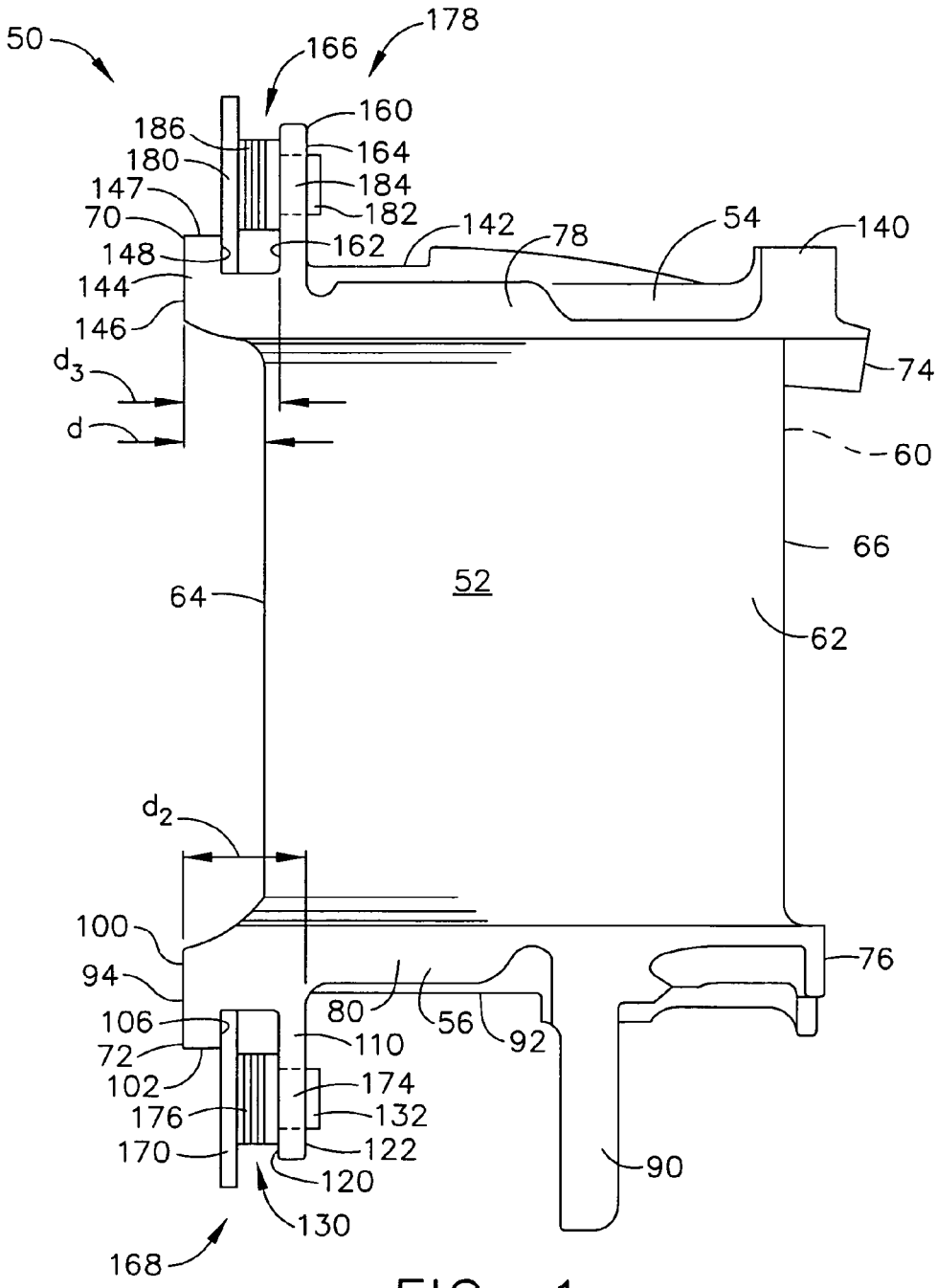
FIG. 1 (PRIOR ART)
FIG. 1 is a side view of an exemplary known turbine nozzle that may be used with a gas turbine engine.

In operation, air flows through low pressure compressor 12 supplying compressed air from low pressure compressor 12 to high pressure compressor 14. The highly compressed air is delivered to combustor 16. Airflow from combustor 16 is channeled through a turbine nozzle (not shown in FIG. 1) to drive turbines 18 and 20, prior to exiting gas turbine engine 10 through an exhaust nozzle 24.

Figure 4:
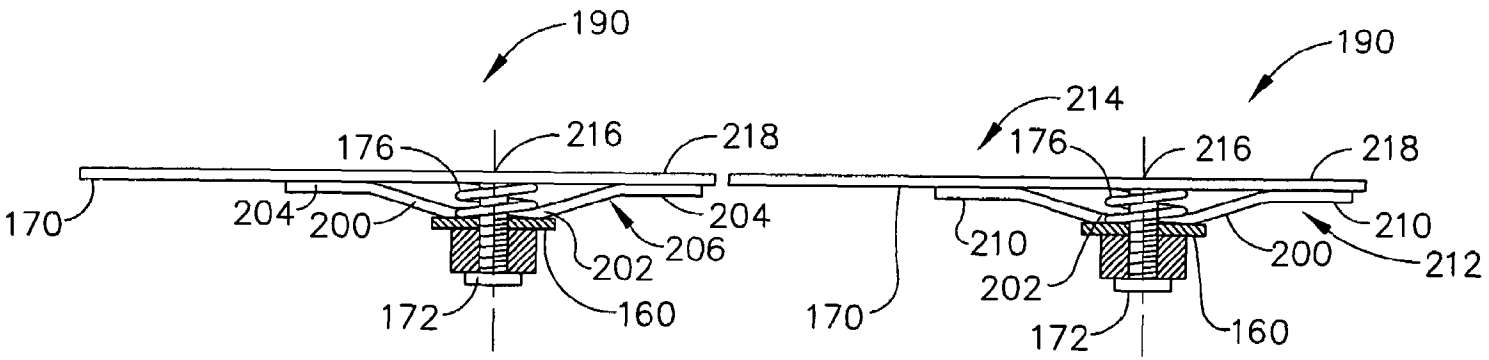
FIG. 4 is a schematic view of an exemplary pair of leaf seal assemblies used with the gas turbine engine shown in FIG. 3.

FIG. 4 is a schematic view of an exemplary pair of circumferentially-adjacent leaf seal assemblies 190 that each include a seal 170 and a seal support 200. Although seal support 200 is described with reference to seal 170, as will be appreciated by one skilled in the art, the description of seal support 200 also applies to seal 180. In the exemplary embodiment, each seal support 200 is coupled to a radial tab 110, via fastener 172. Each seal support 200 is non-planar, such that, in the exemplary embodiment, a mid portion 202 of each seal support 200 is positioned between a spring 176 and the radial tab, and such that both ends 204 of a first seal support 206 are coupled against a first seal 208, and both ends 210 of a second seal support 212 are coupled against a second seal 214.

In the exemplary embodiment, a first portion 216 of each seal 170 is coupled to, and supported by, a radial tab. Each seal first portion 216 is also at least partially supported by at least one spring 176. Moreover, in the exemplary embodiment, each seal 170 includes a second portion 218 that is not coupled against a radial tab or spring 176. Rather, in the exemplary embodiment, a first seal support end 204 is coupled against second portion 218 of first seal 208, and a second seal support end 210 is coupled against second portion 218 of second seal 214.

During operation, leaf seal assemblies 190 seal the nozzle assembly and the combustor interface to facilitate reducing hot gas injection along the vane leading edge and improve the turbine nozzle life-span. Pressure and vibrations induced on seals 170 during operation are at least partially absorbed by springs 176; however portions of seals 170 that are not at least partially supported by springs 176 may become susceptible to cracking and, ultimately, breakage. As such seal supports 200 facilitate further absorption of pressure induced upon seals 170. Accordingly, seal supports 200 facilitate reducing cracking and breakage along seals 170 to facilitate maintaining turbine efficiency and increasing turbine life-span.

Figure 5:
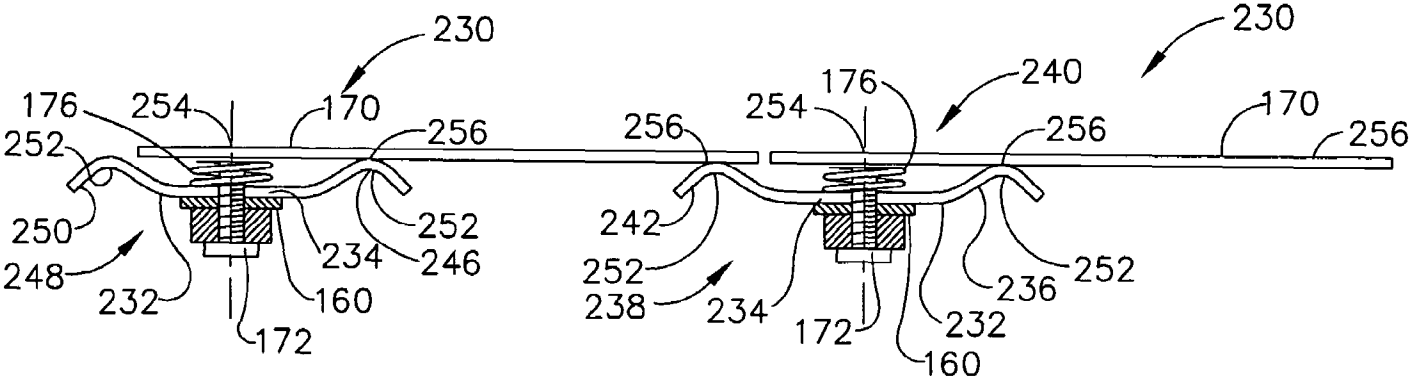
FIG. 5 is a schematic view of an alternative embodiment of a pair of leaf seal assemblies that can be used with the gas turbine engine shown in FIG. 3.

FIG. 5 is a schematic view of an alternative pair of circumferentially-adjacent leaf seal assemblies 230 that each include a seal 170 and a seal support 232. Although seal support 232 is described with reference to seal 170, as will be appreciated by one skilled in the art, the description of seal support 232 also applies to seal 180. In the exemplary embodiment, each seal support 232 is coupled to a radial tab 110, via fastener 172. Each seal support 232 is non-planar, such that, in the exemplary embodiment, a mid portion 234 of each seal support 232 is positioned between a spring 176 and the radial tab, and such that a first end 236 of a first seal support 238 is coupled against a first seal 240, and a second end 242 of first seal support 238 is coupled against a second seal 244. Moreover, a first end 246 of a circumferentially-adjacent second seal support 248 is coupled against second seal 244, and a second end 250 of second seal support 248 is coupled against a third seal (not shown) that is circumferentially-adjacent to second seal support 248. In the exemplary embodiment seal support ends 236, 242, 246, and 250 each include a dimpled recess 252 extending inward from mid portion 234 towards seal 170. However, as will be appreciated by one skilled in the art, seal support ends 236, 242, 246, and 250 may have any suitable shape that enables seal supports 238 and 248 to function as described herein.

In the exemplary embodiment, a first portion 254 of each seal 170 is coupled to, and supported by, a radial tab. More specifically, each seal first portion 254 is at least partially supported by at least one spring 176. Moreover, in the exemplary embodiment, each seal 170 also includes a second portion 256 that is not coupled against or supported by any radial tabs or springs 176. Rather, in the exemplary embodiment, first seal support first end 236 is coupled against a second portion 256 of first seal 240, and second end 242 of first seal support 238 is positioned adjacent a second portion 256 of second seal 244. Moreover, second seal support first end 246 is coupled against a second portion 256 of second seal 244, and second seal support second end 250 is positioned adjacent a second portion 256 of the third seal.

During operation, leaf seal assemblies 230 seal the nozzle assembly and the combustor interface to facilitate reducing hot gas injection along the vane leading edge and improve the turbine nozzle life-span. Pressure and vibrations induced on seals 170 during operation are at least partially absorbed by springs 176; however portions of seals 170 that are not at least partially supported by springs 176 may become susceptible to cracking and, ultimately, breakage. As such seal supports 232 facilitate further absorption of pressure induced upon seals 170. Accordingly, seal supports 232 facilitate reducing cracking and breakage along seals 170 to facilitate maintaining turbine efficiency and increasing turbine life-span.

Figure 2:
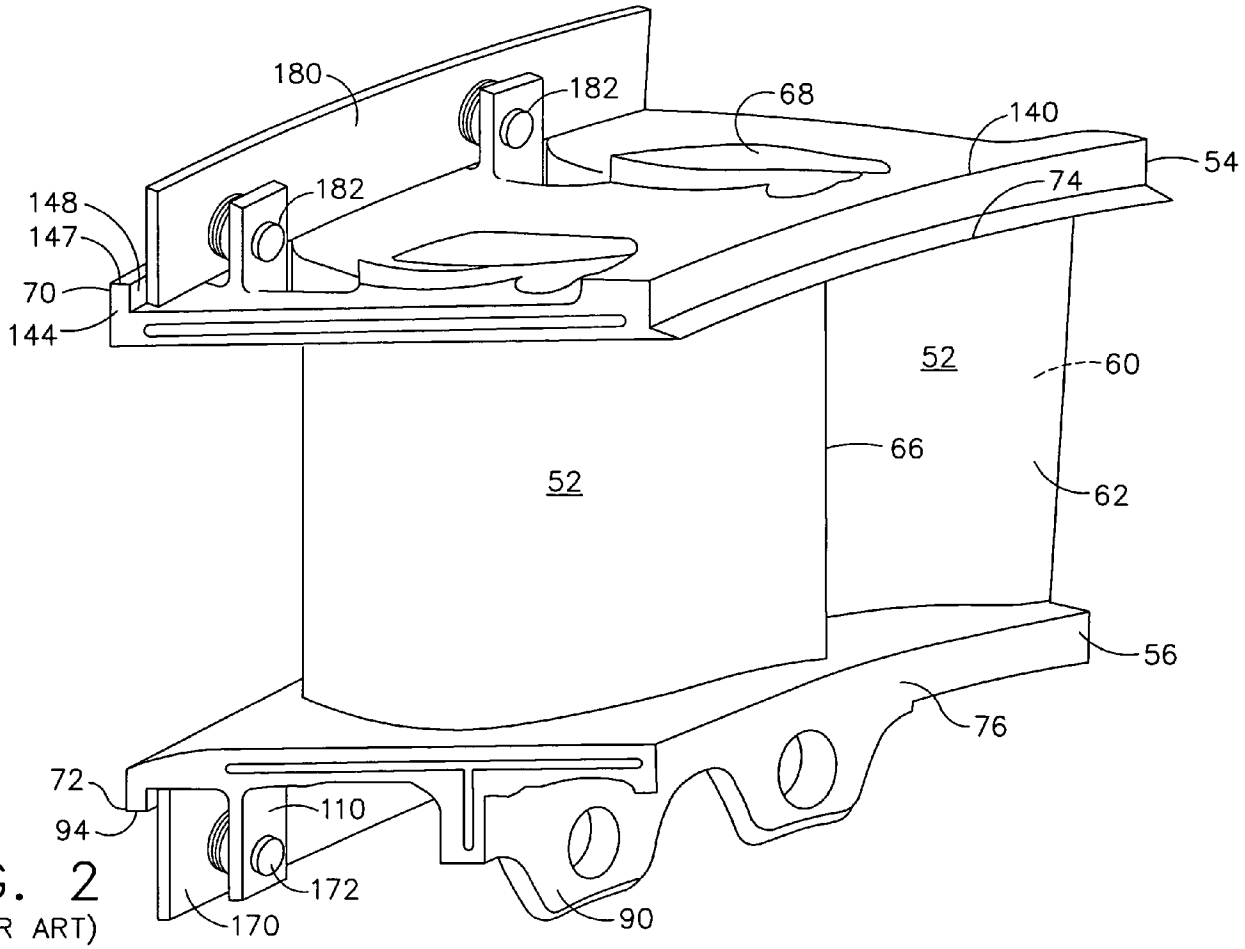
FIG. 2 (PRIOR ART)
FIG. 2 is a perspective view of the turbine nozzle shown in FIG. 1.
Figure 6:
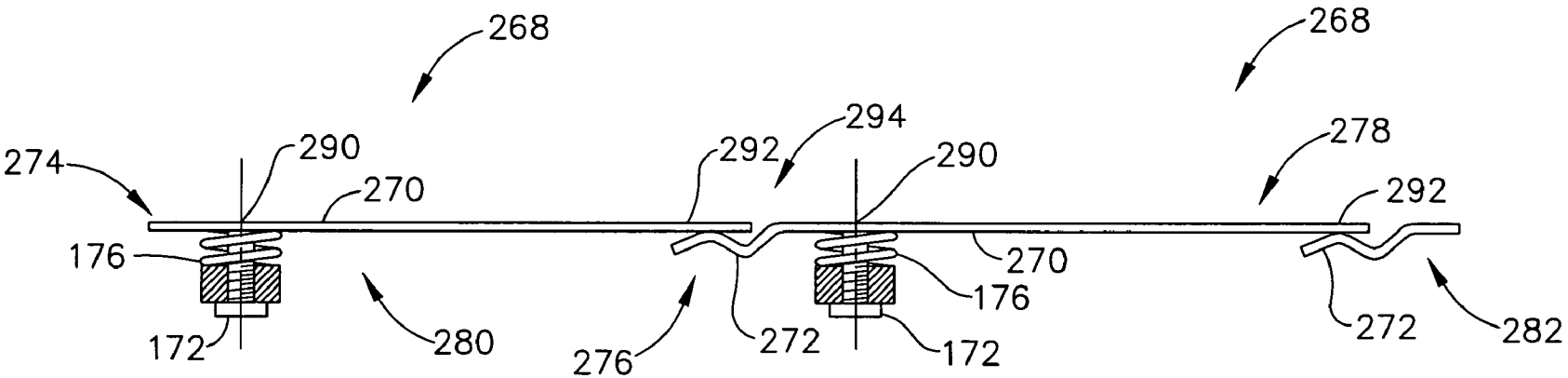
FIG. 6 is a schematic view of another alternative embodiment of a pair of leaf seal assemblies that can be used with the gas turbine engine shown in FIG. 3.

FIG. 6 is a schematic view of another alternative pair of circumferentially-adjacent leaf seal assemblies 268 that each include a seal 270 including a seal support 272 extending therefrom. In the exemplary embodiment, seal 270 is an alternative embodiment of seals 170 and 180 (shown in FIGS. 2 and 3). Specifically, in the exemplary embodiment, each seal support 272 extends from a first end 274 of a respective seal 270 and is coupled against an circumferentially-adjacent seal 270. More specifically, a first seal support 276 extending from a first seal 278 is coupled against a second seal 280, and a second seal support 282 extending from a circumferentially-adjacent third seal (not shown) is coupled against first seal 278. In the exemplary embodiment seal supports 276 and 282 include a dimpled recessed extending towards seal 270. However, as will be appreciated by one skilled in the art, seal supports 276 and 282 may have any suitable shape that enables seal supports 276 and 282 to function as described herein.

In the exemplary embodiment, each seal 270 includes first portion 290 that is supported by, and coupled to a radial tab 160, via fastener 172. More specifically, each seal first portion 290 is also at least partially supported by at least one spring 176. Moreover, in the exemplary embodiment, each seal 270 includes a second portion 292 that is not coupled against or supported by any radial tabs or springs 176. In the exemplary embodiment, first seal support 276 is coupled against second seal second portion 292, and a second seal support 282 is coupled against first seal second portion 292.

During operation, leaf seal assemblies 268 seal the nozzle assembly and the combustor interface to facilitate reducing hot gas injection along the vane leading edge and improve the turbine nozzle life-span. Pressure and vibrations induced on seals 270 during operation are at least partially absorbed by springs 176; however portions of seals 270 that are not at least partially supported by springs 176 may become susceptible to cracking and, ultimately, breakage. As such seal supports 272 facilitate further absorption of pressure induced upon seals 270. Accordingly, seal supports 272 facilitate reducing cracking and breakage along seals 270 to facilitate maintaining turbine efficiency and increasing turbine life-span.

In one embodiment, a method for assembling a gas turbine engine is provided. The method includes providing a turbine nozzle including an outer band and an inner band, wherein each band includes a leading edge, a trailing edge, and a body extending therebetween. At least one of the outer band and the inner band has at least one radial tab extending outward therefrom. The method also includes coupling at least one seal between at least one of the radial tabs extending from the outer band and the inner band and a respective leading edge of the outer and inner band. The method also includes positioning at least one non-planar seal support against at least one portion of the seal.

The above-described methods and apparatus provide a nozzle assembly seal support that facilitates reducing cracking and breakage in the nozzle assembly seals. Specifically, the seal support provides support for portions of the seal that are not coupled to or supported by the radial tabs or springs of the nozzle assembly. As such, these portions of the seal are enabled to withstand pressure increases and vibrations caused by operation of the turbine. Accordingly, the seal supports facilitate reducing cracking and breakage along the seals to facilitate maintaining turbine efficiency and increasing turbine life-span.

As used herein, an element or step recited in the singular and proceeded with the word a or should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the methods and systems described herein are described in the context of nozzle assemblies for a gas turbine engine, it is understood that the nozzle assembly methods and systems described herein are not limited to gas turbine engines. Likewise, the nozzle assembly components illustrated are not limited to the specific embodiments described herein, but rather, components of the nozzle assembly can be utilized independently and separately from other components described herein.

While the invention has been described in terms of various specific embodiments, those skilled in the art will recognize that the invention can be practiced with modification within the spirit and scope of the claims.

The invention claimed is:

1. A method for assembling a gas turbine engine, said method comprising:

providing a turbine nozzle including an outer band and an inner band, wherein each band includes a leading edge, a trailing edge, and a body extending therebetween, wherein at least one of the outer band and the inner band has at least one radial tab extending outward therefrom;

coupling at least one seal between at least one of the radial tabs extending from the outer band and the inner band and a respective leading edge of the outer and inner band; and coupling, using a single fastener, at least one non-planar seal support in biasing arrangement against at least one portion of the seal with a coiled spring.

2. A method in accordance with claim 1 wherein coupling at least one seal further comprises:

positioning the seal such that a first portion of the seal is supported by the at least one radial tab and such that a second portion of the seal is unsupported by the at least one radial tab; and positioning an end of the seal support against the second portion of the seal.

3. A method in accordance with claim 1 wherein coupling at least one seal further comprises:

positioning the seal such that a first portion of the seal is supported by the at least one radial tab and such that a second portion of the seal is unsupported by the at least one radial tab;

positioning a first end of the seal support against the second portion; and positioning a second end of the seal support against a second portion of a circumferentially-adjacent seal.

4. A method in accordance with claim 1 further comprising;

extending the seal support from an end of the seal; and positioning the seal support against a circumferentially-adjacent seal.

5. A method in accordance with claim 1 further comprising coupling a spring between the seal and the at least one radial tab.

6. A method in accordance with claim 1 further comprising positioning the seal support against the seal to facilitate preventing breakage of the seal due to vibration.

7. A method in accordance with claim 1 wherein positioning at least one seal support further comprises positioning at least one seal support having at least one dimpled end.

8. A turbine engine nozzle assembly comprising:

an outer band comprising a leading edge, a trailing edge, and a body extending therebetween;

an inner band comprising a leading edge, a trailing edge, and a body extending therebetween, at least one of said inner band and said outer band further comprises at least one radial tab extending outward therefrom;

at least one vane extending between said outer and inner bands;

at least one seal coupled between at least one radial tab and one of said band leading edges; and at least one non-planar seal support coupled in biasing arrangement to at least one portion of said seal with a coiled spring using a single fastener.

9. A turbine engine nozzle assembly in accordance with claim 8 wherein a first portion of said seal is supported by said at least one radial tab and a second portion of said seal is unsupported by said at least one radial tab, said seal support comprises an end that is against said seal second portion.

10. A turbine engine nozzle assembly in accordance with claim 8 wherein a first portion of said seal is supported by said at least one radial tab and a second portion of said seal is unsupported by said at least one radial tab, said seal support comprises an end that is against a second portion of a circumferentially-adjacent seal.

11. A turbine engine nozzle assembly in accordance with claim 8 wherein said seal support extends from an end of said seal and is positioned against a circumferentially-adjacent seal.

12. A turbine engine nozzle assembly in accordance with claim 8 further comprising a spring coupled between said seal and said at least one radial tab.

13. A turbine engine nozzle assembly in accordance with claim 8 wherein said seal support facilitates preventing breakage of said seal due to vibration.

14. A turbine engine nozzle assembly in accordance with claim 8 wherein said seal support comprises at least one dimpled end.

15. A turbine engine comprising:

a plurality of adjacent nozzle assemblies, each said nozzle assembly comprising:

an outer band comprising a leading edge, a trailing edge, and a body extending therebetween;

an inner band comprising a leading edge, a trailing edge, and a body extending therebetween, at least one of said inner band and said outer band further comprises at least one radial tab extending outward therefrom;

at least one vane extending between said outer and inner bands;

at least one seal coupled between at least one radial tab and of said band leading edges; and at least one non-planar seal support coupled in biasing arrangement to at least one portion of said seal with a coiled spring using a single fastener to facilitate preventing breakage of said seal due to vibration.

16. A turbine engine in accordance with claim 15 wherein a first portion of said seal is supported by said at least one radial tab and a second portion of said seal is unsupported by said at least one radial tab, said seal support comprises an end that is against said seal second portion.

17. A turbine engine in accordance with claim 15 wherein a first portion of said seal is supported by said at least one radial tab and a second portion of said seal is unsupported by said at least one radial tab, said seal support comprises an end that is against a second portion of a circumferentially-adjacent seal.

18. A turbine engine in accordance with claim 15 wherein said seal support extends from an end of said seal and is positioned against a circumferentially-adjacent seal.

19. A turbine engine in accordance with claim 15 further comprising a spring coupled between said seal and said at least one radial tab.

20. A turbine engine in accordance with claim 15 wherein said seal support comprises at least one dimpled end.

* * * * *